US006073915A

United States Patent [19]

Taylor et al.

[11] Patent Number: 6,073,915

[45] Date of Patent: Jun. 13, 2000

[54] MOTORCYCLE JACK

[76] Inventors: Roger Taylor, Homeleigh, Whitecross Lane, Banewell, North Somerset, BS24 6DP; Michael Coward, 10 Chestnut Walk, Bishopsworth, Bristol, BS13 7RJ, both of United Kingdom

[21] Appl. No.: 09/255,446

[22] Filed: Feb. 23, 1999

[51] Int. Cl.[7] ..... B66F 3/00

[52] U.S. Cl. ..... 254/126; 254/89 R

[58] Field of Search ..... 254/89 R, 92, 254/126

[56] References Cited

U.S. PATENT DOCUMENTS

| | | | |
|---|---|---|---|
| 1,372,551 | 3/1921 | Roberts | 254/126 |
| 2,183,427 | 12/1939 | Hou | 254/126 |
| 3,384,349 | 5/1968 | Johnson | 254/126 |
| 5,324,002 | 6/1994 | Obernberger . | |

FOREIGN PATENT DOCUMENTS

| | | |
|---|---|---|
| 268916 | 4/1927 | United Kingdom . |
| 297968 | 10/1928 | United Kingdom . |
| 496924 | 12/1938 | United Kingdom . |

*Primary Examiner*—Timothy V. Eley
*Assistant Examiner*—Benjamin M. Halpern
*Attorney, Agent, or Firm*—Larson & Taylor

[57] ABSTRACT

A motorcycle jack including a support assembly (SA) for engagement with a first part (S) of a motorcycle and a lifting assembly (LA) for engagement with a second part (S) of the motorcycle, the first and second parts being on opposite sides of the motorcycle. The lifting assembly (LA) is adjustable between an initial position in which both motorcycle wheels (W) are in contact with the ground and a lifted position in which one motorcycle wheel is raised above the ground (G).

13 Claims, 8 Drawing Sheets

MOTORCYCLE JACK

The present invention relates to motorcycle jacks. It is to be understood that the term "motorcycle" is intended to cover all two wheeled motor vehicles with or without side cars.

Many modern motorcycles do not have centre stands fitted to the underside of the chassis of the motorcycle, which makes it extremely difficult, if not impossible, to lift and support the motorcycle, for example for the removal of wheels and maintenance of chains and suspension etc.

It is therefore desirable to provide a motorcycle jack which can be used in an emergency situation at the roadside or at home and which may be used safely and quickly by one person. Ideally, the jack should be collapsible, so that it can be transported either under the seat of the motorcycle or stowed in luggage.

According to the present invention there is provided a motorcycle jack comprising a support assembly for engagement with a first part of a motorcycle and a lifting assembly for engagement with a second part of the motorcycle, the first and second parts being on opposite sides of the motorcycle, wherein the lifting assembly is adjustable when in use between an initial position in which both motorcycle wheels are in contact with the ground and a lifted position in which at least one motorcycle wheel is raised above the ground.

Such a jack is suitable for use with motorcycles having side stands, in which the motorcycle is supported in an inclined position by the stand. The support assembly of the jack can be engaged with the higher side of the motorcycle of the two sides and the lifting assembly can then be engaged with the opposite side of the motorcycle (i.e. the side of the motorcycle to which the side stand swings out). The height of the lifting assembly can then be increased, such that the wheel of the motorcycle is lifted clear of the ground surface.

For a better understanding of the invention, and to show how the same may be carried into effect, reference will now be made, by way of example, to the accompanying drawings, in which.

Figure 1:
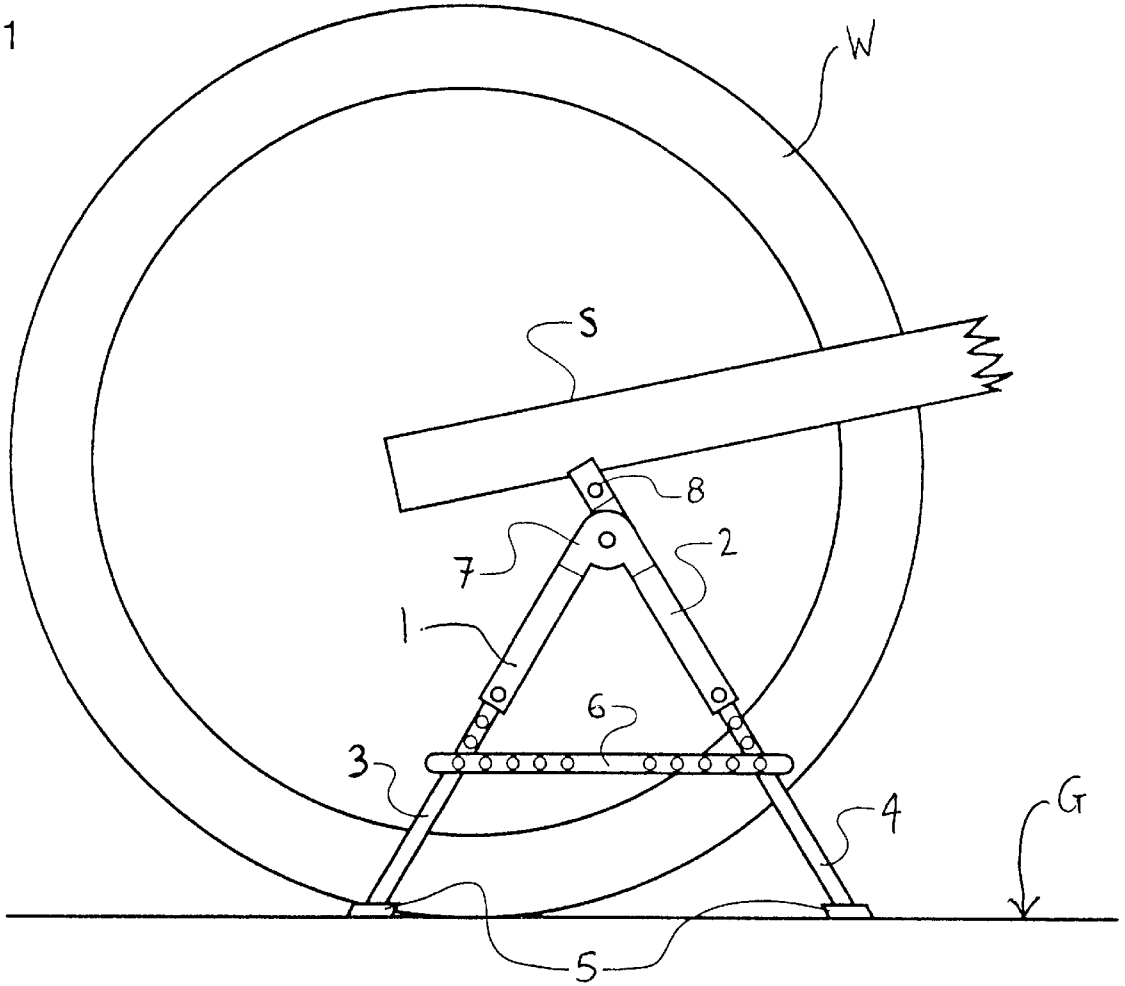
FIG. 1 shows a support assembly of a motorcycle jack embodying the present invention.
Figure 2:
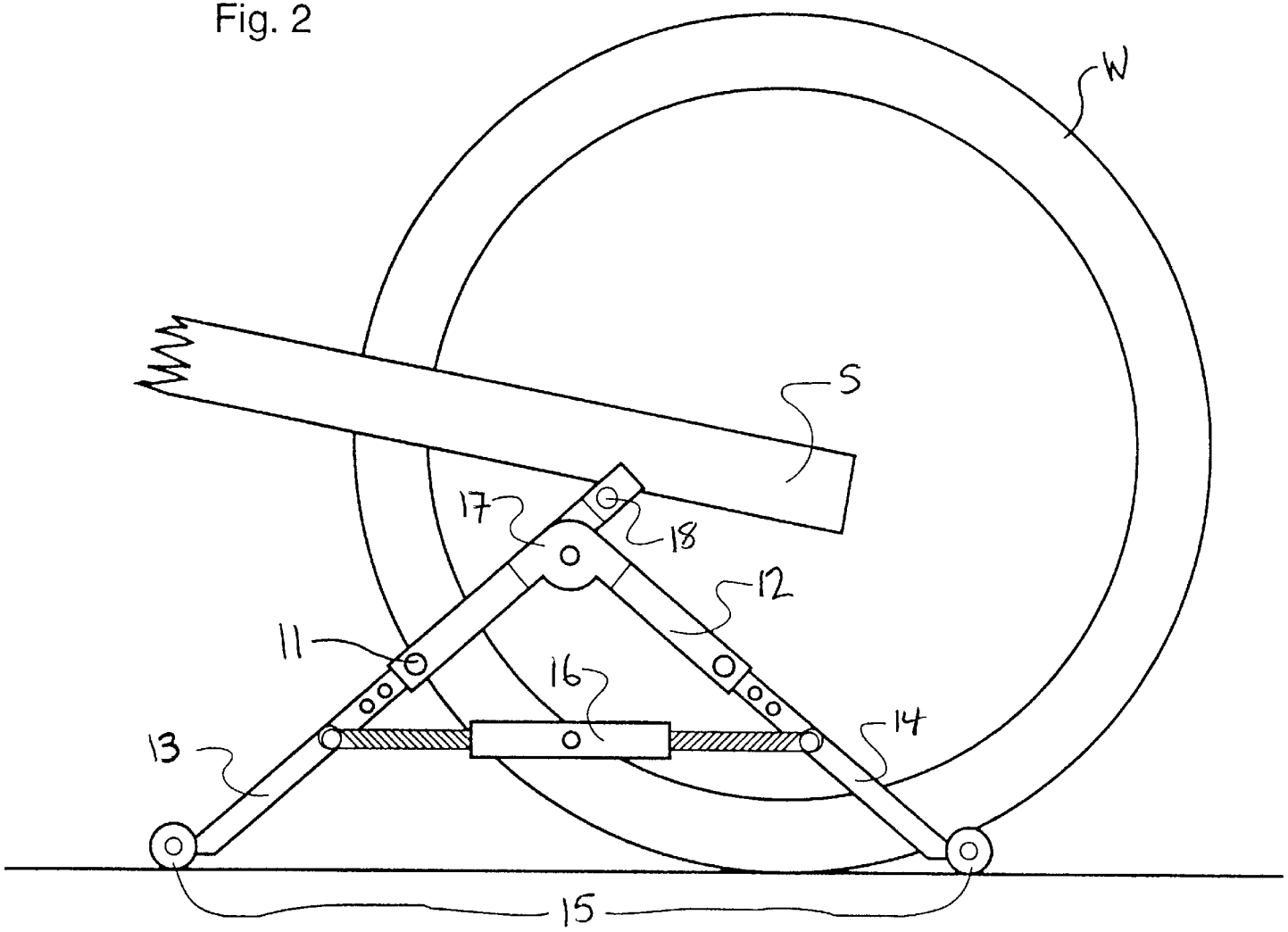
FIG. 2 shows a lifting assembly of the jack of FIG. 1.

As can be seen from FIGS. 1 and 2, a jack embodying the present invention comprises a support assembly (FIG. 1) and lifting assembly (FIG. 2).

As shown in FIG. 1, the support assembly has a substantially A-frame construction. A first hollow outer member 1 slidably engages with a first inner member 3 to provide a first longitudinally extendible ground engaging member. A second longitudinally extendible ground engaging member is provided by an outer member 2 and inner member 4. The inner members 3 and 4 have ground engaging parts 5 for engagement with a ground surface G.

The inner members 3 and 4 are adapted to slide within the respective outer members 1 and 2 and the relative positions of the inner and outer members can be fixed by means of pins (not shown). The inner and/or outer members may be formed from steel box section, or tube, for example. The outer and inner members can also be provided by open channel or 'C' section members.

The outer sections are rotatably connected to one another by way of at least one hinge 7. The height of the support assembly is set and adjusted by way of an adjustment strut 6 which engages with central regions of the inner members 3 and 4. Variation in the length of the struts 6 alters the height of the support assembly.

The strut 6 is preferably provided by a check strap having a preset number of holes which engage with corresponding pegs on the ground engaging members. The height is thereby adjusted in discrete increments by varying the hole/peg engagement. Alternatively, a rigid strut 6 could be used.

The support assembly engages with a swing arm S of a motorcycle by way of an engagement part 8. The engagement part 8 engages with a bracket mounted on the swing arm, with an existing threaded bush on the swing arm, with an end of a wheel spindle, or with any other suitable part of the motorcycle.

FIG. 2 shows the lifting assembly of the jack embodying the present invention. The lifting assembly has a similar construction to the support assembly, in as much as it generally comprises an A-frame. Outer parts 11 and 12 engage with respective inner parts 13 and 14 to provide a pair of ground engaging members which are adjustable in length. The inner parts 13 and 14 carry ground engaging members 15 which are preferably in the form of wheels, as shown in FIG. 2.

As in the support assembly shown in FIG. 1, the outer parts 11 and 12 are connected to one another by way of at least one hinge 17. An adjustable strut 16 is provided between the two outer members 13 and 14, and allows the height of the lifting part be adjusted. In FIG. 2 the adjustable strut 16 is provided by a turnbuckle, which is turned to adjust the spacing of the ground engaging members. Such adjustment adjusts the height of the lifting assembly continuously from an initial position to a lifting position. With the turnbuckle arrangement the motorcycle can be continuously supported while lifted.

The lifting assembly is attached to the swing arm S of the motorcycle by way of a bracket 18 which engages with a bracket on the swing arm, in a threaded bush of the swing arm S or by any other appropriate means.

Operation of the jack embodying the present invention and shown in FIGS. 1 and 2, will now be described with reference to FIGS. 3, 4 and 5.

Figure 3:
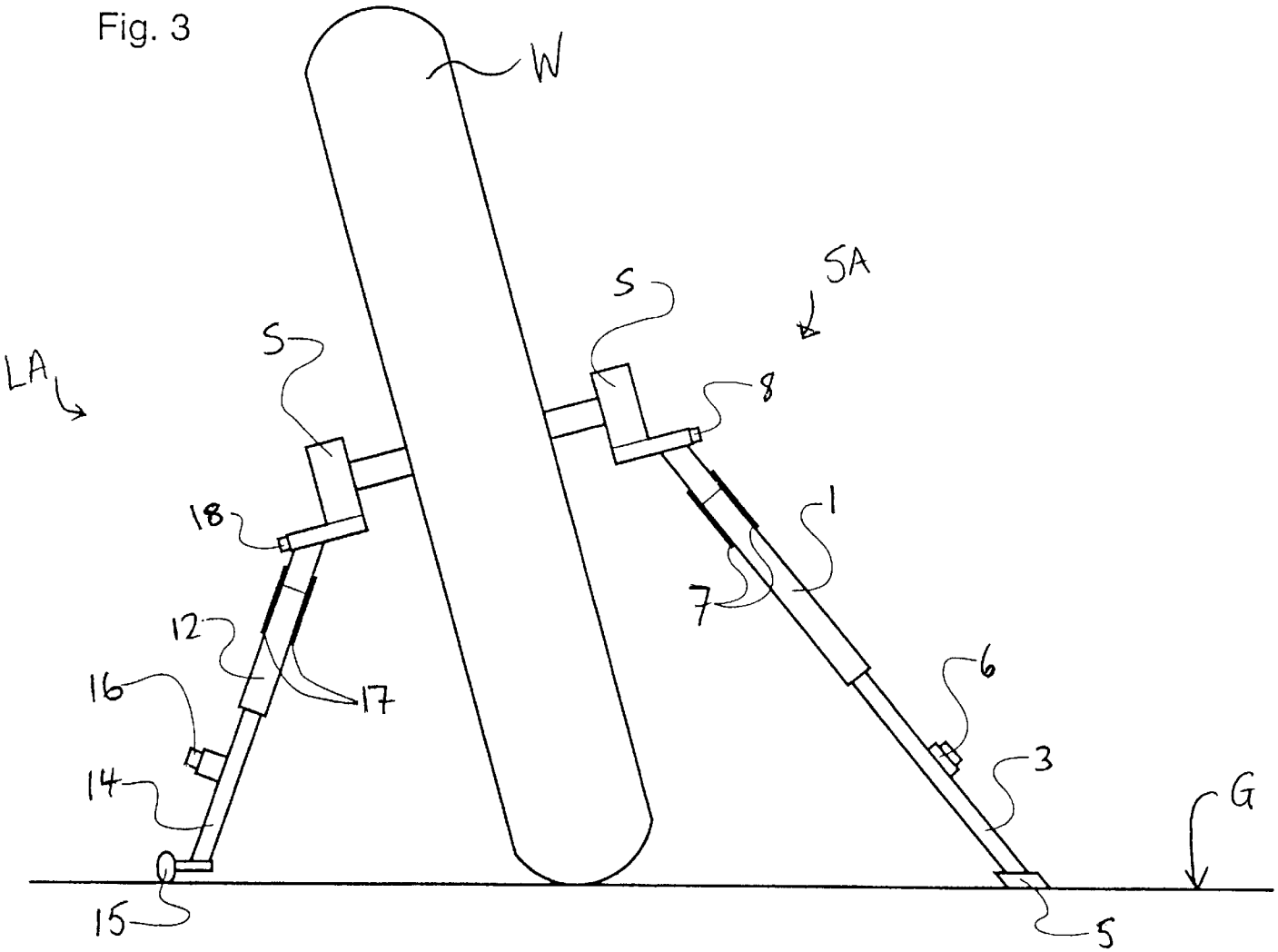
FIG. 3 Shows an end view of a jack embodying the present invention attached to a motorcycle wheel and in an initial position.
Figure 4:
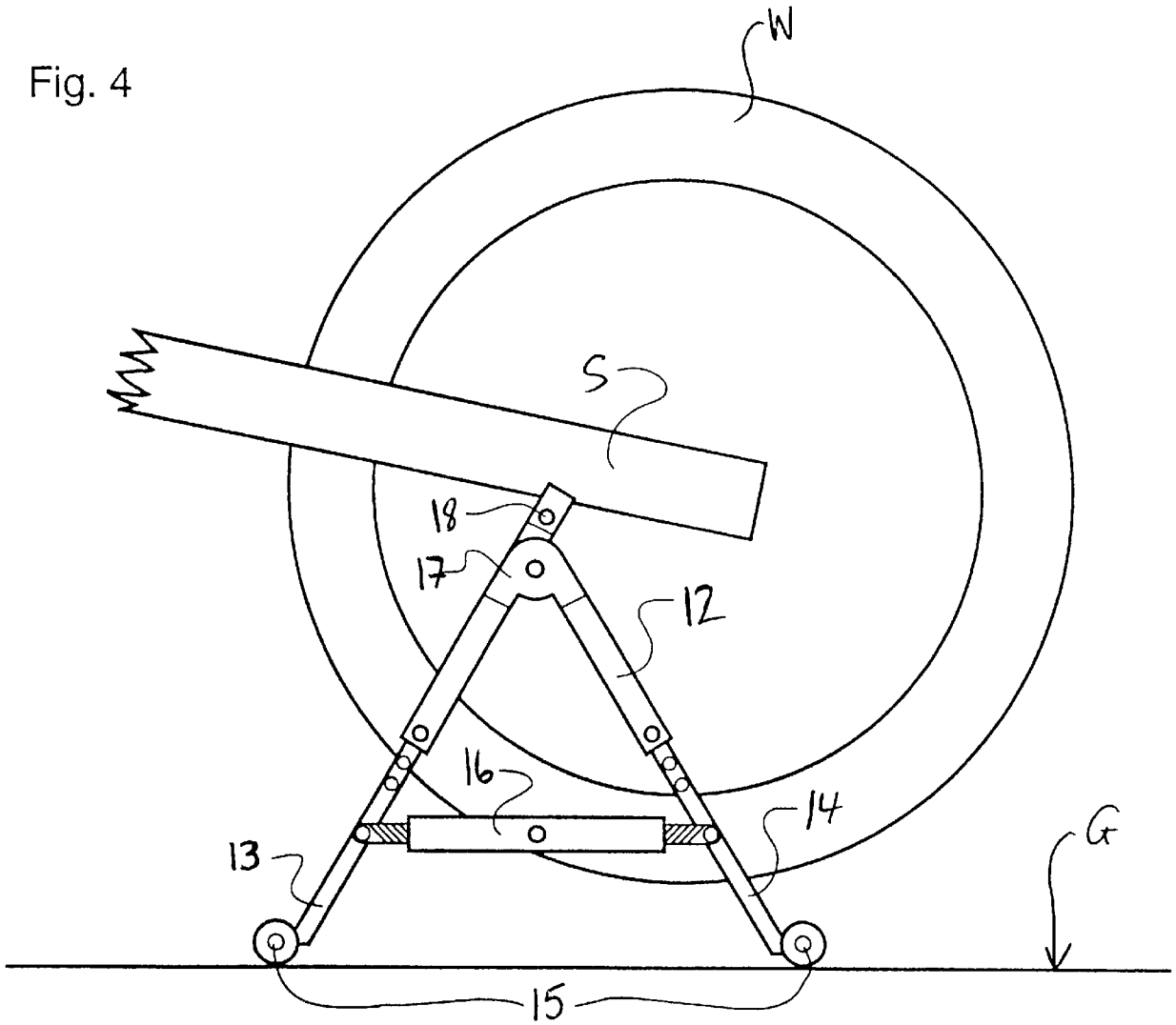
FIG. 4 shows the jack of FIG. 2 in a lifted position.

The initial position of the jack is shown in FIG. 3, in which the motorcycle is supported in an inclined position, and the support assembly is engaged with the higher side of the swing arm. The adjustment member 6 is adjusted so that the height of the support assembly coincides with the swing arm bracket so that the engagement member 8 is then engaged with the bracket.

The lifting assembly is adjusted by way of the turnbuckle 16 so that it extends from the ground to the swing arm bracket on the opposite side of the wheel W. It is then fixed to the swing arm bracket by means of for example one or more bolts.

In order to raise the wheel W from the ground, the turnbuckle 16 is turned so that the ground engaging members are moved together, thereby raising the engagement part 18. This in turn lifts the swing arm S on the lifting assembly side of the motorcycle above the ground thus raising the wheel W. This lifted position is shown in FIG. 4, and as can be seen from the Figure the turnbuckle 16 has been adjusted such that the wheel is raised from the ground.

Figure 5:
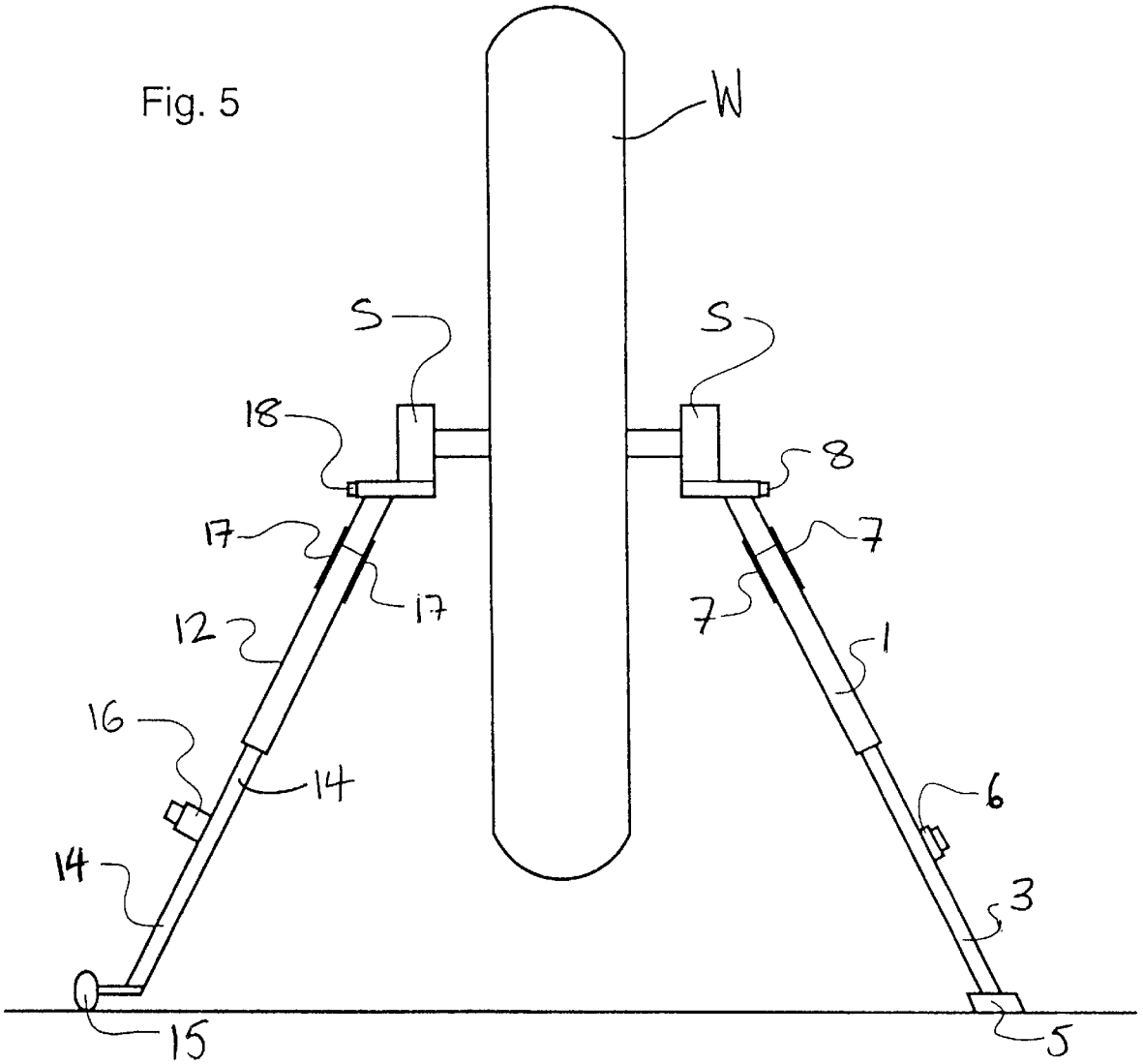
FIG. 5 shows the jack embodying the resent invention in a lifted position.

FIG. 5 shows an and view of the wheel W in a raised position. It will be appreciated that as the lifting adjustment member 16 is turned so as to raise the wheel, the lifting ground engaging members are pulled towards one another such that the wheels 15 roll along the ground G. It will also be appreciated that to lower the wheel back on the ground, the turnbuckle 16 is simply rotated in the opposite direction to increase the spacing of the ground engaging member.

Figure 6:
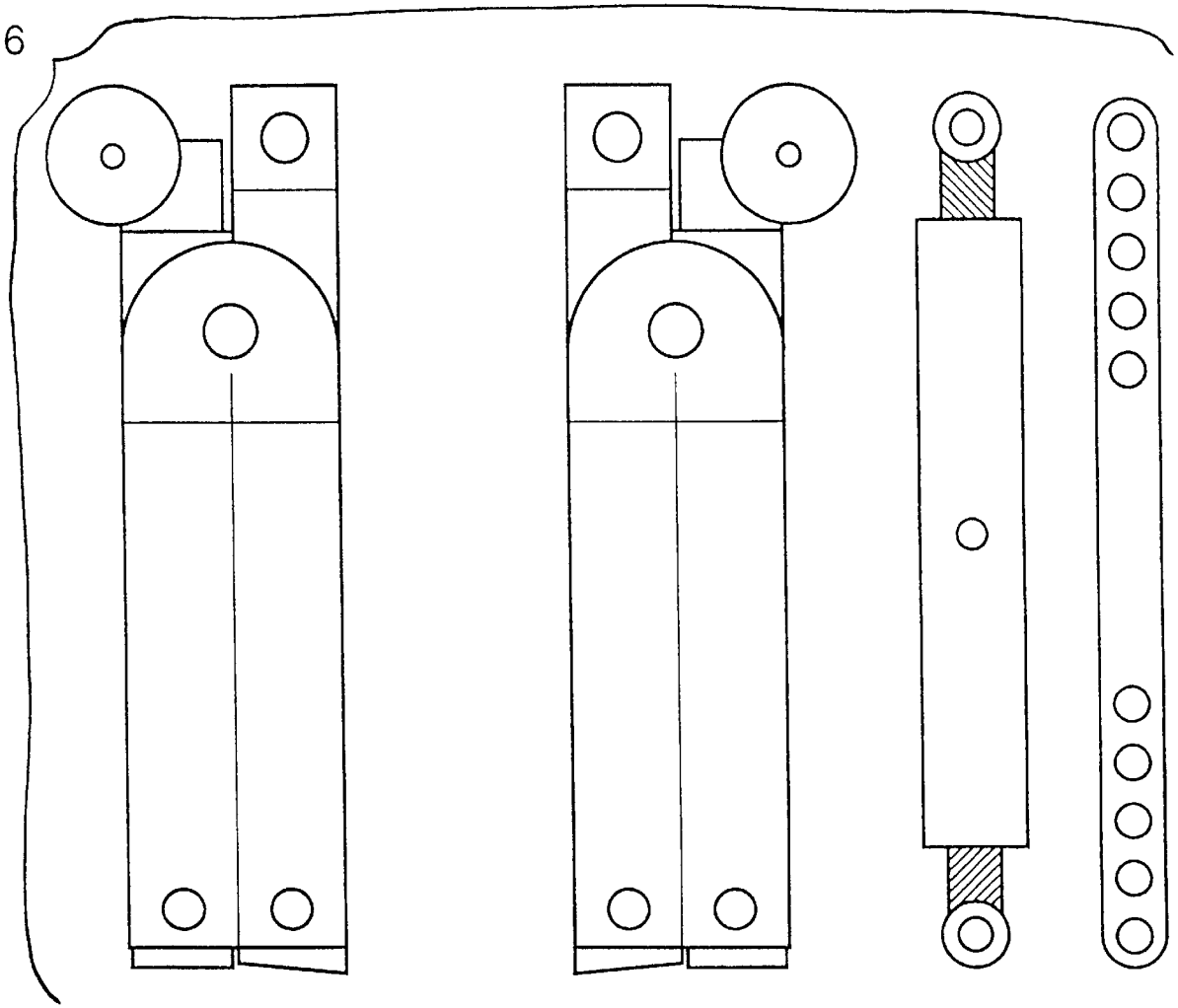
FIG. 6 shows component parts of a jack embodying the present invention.

FIG. 6 illustrates a major advantage of the jack embodying the present invention, namely that it can be dismantled and stored in a small space. The support and lifting adjustment members 6 and 16 can be removed from their respective pairs of ground engaging members. This allows the A-frame constructions to be completely collapsed, the inner parts being pushed up into the respective outer parts.

As shown in FIG. 6, a more compact solution can be found in which one of the wheeled ground engaging inner members 13 or 14 is swapped with one of the ground engaging members 3 or 4. In addition the wheeled ground engaging inner members can be reversed within the outer members, thereby making the collapsed assembly even more compact.

Figure 7:
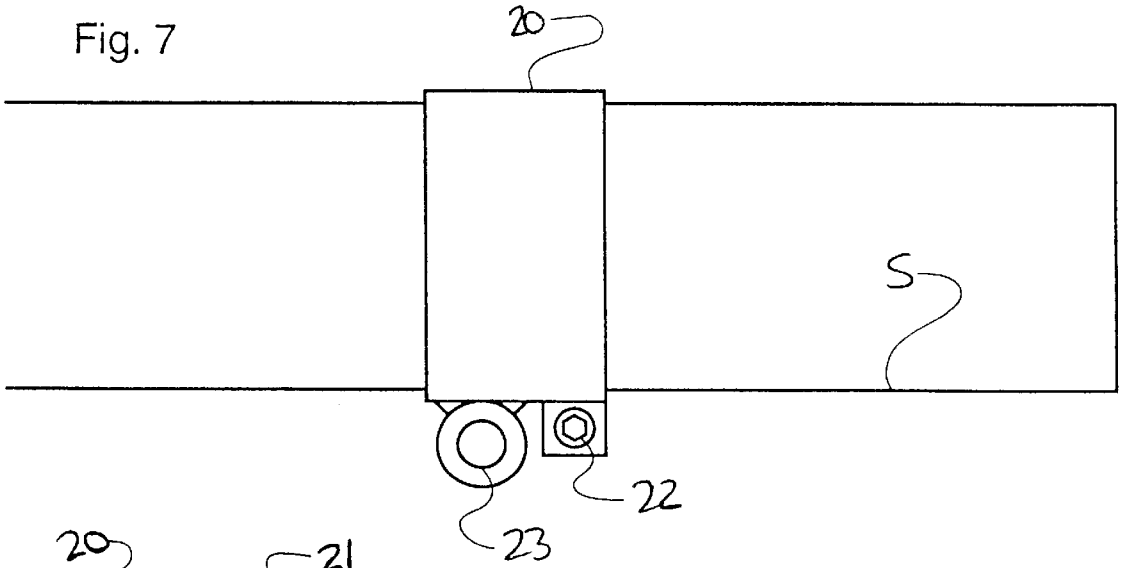
FIGS. 7 and 8 show respective side and end views of brackets for use with the jack embodying the present invention.
Figure 8:
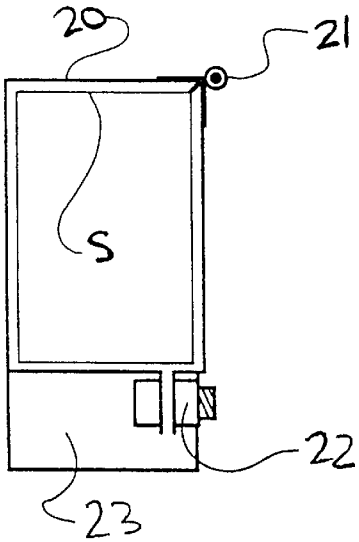
Figure 10:
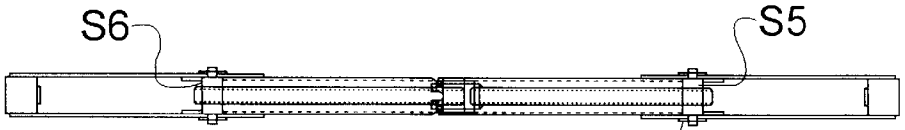
FIGS. 9 to 12 show an alternative embodiment of the present invention.
Figure 11:
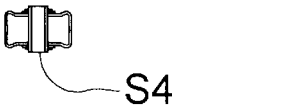
Figure 11:
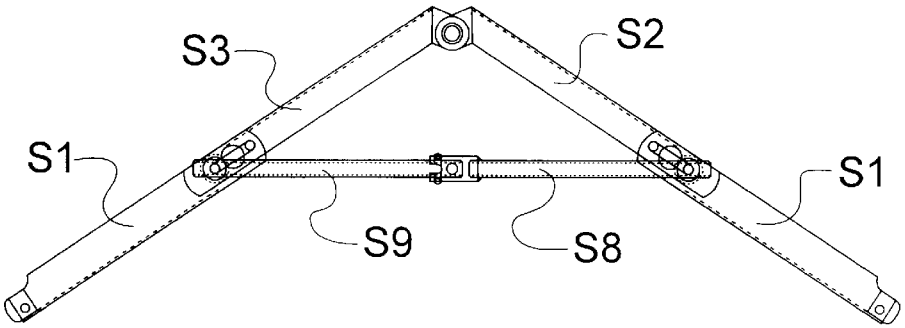
Figure 12:
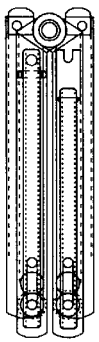
Figure 9:
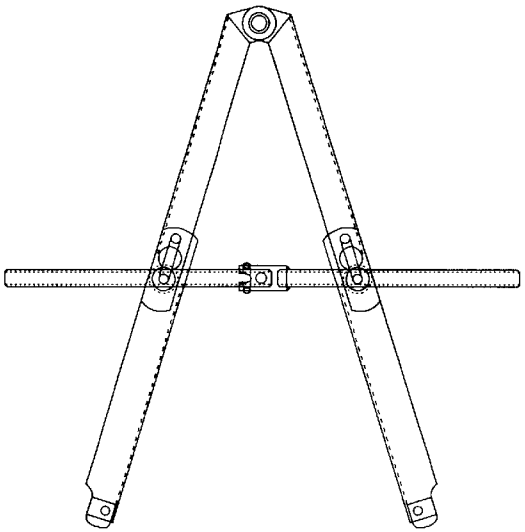

FIGS. 7 and 8 show a bracket to which the jack embodying the present invention may be attached. The bracket 20 is fitted around the swing arm S, and includes two parts connected by a hinge which allows. the bracket to be fitted to the swing arm. A tensioning bolt 22 tightens the assembly around the swing arm S such that the bracket 20 is rigidly attached to the swing arm. A bush 23 is provided for engagement with the jack.

It will be readily appreciated that in an alternative embodiment of the present invention the check strap 6 of the support assembly could be replaced by a turnbuckle arrangement. Such an arrangement is advantageous when it is to be used on a variety of motorcycles having various ground clearances and wheel axle and swing arm heights.

It will also be readily appreciated that the jack can be fitted to any desired part of the motorcycle, provided that a suitable bracket is fitted to that part.

The bracket may be welded or otherwise rigidly attached to the motorcycle in order to provide a suitable lifting point for the jack.

A jack embodying the present invention has the significant advantage that it can be operated safely and efficiently by one person. The embodiment described is also very compact, which enables the jack to be stored beneath the seat of the motorcycle, for example, or in luggage of the motorcycle rider. In addition, the separate support and lifting assemblies of the jack enable the jack to be used on most road surfaces, including those having cambers.

Additionally, it may be used to provide stability when the motorcycle is parked or to support the motorcycle when it is not in use so that distortion of the front and/or rear tyre can be prevented.

As mentioned, the inner and outer members can be provided by 'C' section or channel section members. When these members are of open section, the motorcycle jack can be easily folded for storage. For example, the turnbuckle arrangement 16 can be replaced by a split arrangement joined by a pin. When the jack is to be folded, then the screw thread arrangement is split into two for folding into the appropriate C section.

A further modification is the replacement of the fixings provided between the inner and outer members and between the adjustment arrangement and the inner members by a single fixing for each side of the A frame. Such a single fixing reduces the amount of welding required to fabricate the jack.

A jack using 'C' section members, a split turnbuckle arrangement, and a single fixing as described above as shown in FIGS. 9 to 12, as an example.

What is claimed is:

1. A motorcycle jack comprising:

a planar support assembly for a first lateral side of a motorcycle including a first engagement member for engagement with a first part of the motorcycle on the first side such that the first part of the motorcycle is rigidly supportable on the first side by said support assembly; and a planar lifting assembly separate from and unconnected to said support assembly for a second lateral side of the motorcycle including a second engagement member for engagement with a second part of the motorcycle on the second side such that the second part of the motorcycle is rigidly supportable on the second side by said lifting assembly, the first and second parts being on opposite lateral sides of the motorcycle, wherein the lifting assembly further includes an adjustment means for adjusting a height of said second engagement member between an initial position in which both motorcycle wheels are in contact with the ground and a lifted position in which one motorcycle wheel is raised above the ground and is supported by said support assembly on the first side and said lifting assembly on the second side.

2. A jack as claimed in claim 1, wherein the support assembly includes a positioning means for adjusting a height of said first engagement member between an initial position and a lifting position.

3. A jack as claimed in claim 1, wherein the support assembly has a substantially A-frame construction, comprising:

a pair of longitudinally extendible ground engaging members, a connector for the ground engaging members by which the ground engaging members are rotatably connected to one another at end regions thereof, a motorcycle engagement portion serving as said first engagement member which extends away from the connector for engagement with the motorcycle, and a support adjustment member which extends between and engages with respective central regions of the ground engaging members, the support adjustment member serving to set the distance between the ground engaging members and hence to set a height of said motorcycle engagement portion.

4. A jack as claimed in claim 1, wherein the lifting assembly has a substantially A-frame construction, comprising:

a pair of longitudinally extendible ground engaging members, a connector for the ground engaging members by which the ground engaging members are rotatably connected to one another at end regions thereof, and a lifting adjustment member serving as the adjustment means which extends between and engages with respective central regions of the ground engaging members, the lifting adjustment member serving to vary the distance between the ground engaging members and hence to vary a height of said motorcycle engagement portion.

5. A jack as claimed in claim 1, wherein the support assembly has a substantially A-frame construction, comprising:

a pair of longitudinally extendible ground engaging members, a connector for the ground engaging members by which the ground engaging members are rotatably connected to one another at end regions thereof, a motorcycle engagement portion serving as said first engagement member which extends away from the connector for engagement with the motorcycle, and a support adjustment member which extends between and engages with respective central regions of the ground engaging members, the support adjustment member serving to set the distance between the ground engaging members and hence to set a height of said motorcycle engagement portion, and wherein the support adjustment member is a turnbuckle arrangement which is continuously adjustable to set the distance between the pair of ground engaging members.

6. A jack as claimed in claim 1, wherein the support assembly has a substantially A-frame construction, comprising:

a pair of longitudinally extendible ground engaging members, a connector for the ground engaging members by which the ground engaging members are rotatably connected to one another at end regions thereof, a motorcycle engagement portion serving as said first engagement member which extends away from the connector for engagement with the motorcycle, and a support adjustment member which extends between and engages with respective central regions of the ground engaging members, the support adjustment member serving to set the distance between the ground engaging members and hence to set a height of said motorcycle engagement portion, and wherein the support adjustment member is a check strap which defines a predetermined number of discrete distances between the ground engaging members.

7. A jack as claimed in claim 4, wherein the support assembly has a substantially A-frame construction, comprising:

a pair of longitudinally extendible ground engaging members, a connector for the ground engaging members by which the ground engaging members are rotatably connected to one another at end regions thereof, a motorcycle engagement portion serving as said first engagement member which extends away from the connector for engagement with the motorcycle, and a support adjustment member which extends between and engages with respective central regions of the ground engaging members, the support adjustment member serving to set the distance between the ground engaging members and hence to set a height of said motorcycle engagement portion; and wherein the lifting adjustment member is a turnbuckle arrangement which is continuously adjustable to vary the distance between the pair of ground engaging members of said lifting assembly.

8. A jack as claimed in claim 4, wherein the support assembly has a substantially A-frame construction, comprising:

a pair of longitudinally extendible ground engaging members, a connector for the ground engaging members by which the ground engaging members are rotatably connected to one another at end regions thereof, a motorcycle engagement portion serving as said first engagement member which extends away from the connector for engagement with the motorcycle, and a support adjustment member which extends between and engages with respective central regions of the ground engaging members, the support adjustment member serving to set the distance between the ground engaging members and hence to set a height of said motorcycle engagement portion; and wherein the support adjustment member is detachable from the ground engaging members of said support assembly and the lifting adjustment member is detachable from the ground engaging members of said lifting assembly, such that the jack can be folded for compact storage.

9. A jack as claimed in claim 1, wherein the support assembly has a substantially A-frame construction, comprising:

a pair of longitudinally extendible ground engaging members, a connector for the ground engaging members by which the ground engaging members are rotatably connected to one another at end regions thereof, a motorcycle engagement portion serving as said first engagement member which extends away from the connector for engagement with the motorcycle, and a support adjustment member which extends between and engages with respective central regions of the ground engaging members, the support adjustment member serving to set the distance between the ground engaging members and hence to set a height of said motorcycle engagement portion; and wherein the first and second engagement members are for engagement with brackets on a swing arm of a motorcycle.

10. A jack as claimed in claim 9, wherein the brackets are welded to the swinging arm.

11. A jack as claimed in claim 9, wherein the brackets are bolted to the swinging arm.

12. A jack as claimed in claim 1, wherein the lifting assembly is supported on wheels.

13. A motorcycle jack comprising:

a planar support assembly including a) a first member which engages a first part of a motorcycle on a first lateral side thereof, b) a rigid frame to which said first member is attached, said rigid frame including ground engaging parts; and a planar lifting assembly separate from and unconnected to said support assembly and including a) a second member which engages a second part of the motorcycle on a second lateral side thereof opposite to the first side, b) an A-frame to which said second member is attached, said A-frame including a pair of extendible ground engaging members hingedly connected together at a proximal end thereof, c) an adjustment means for varying a distance between said ground engaging members in order to vary a height of said second engagement member between an initial position in which both motorcycle wheels are in contact with the ground and a lifted position in which one motorcycle wheel is raised above the ground and is supported by said support assembly on the first side and said lifting assembly on the second side.

* * * * *